US010325545B2

(12) United States Patent
Zheng et al.

(10) Patent No.: US 10,325,545 B2
(45) Date of Patent: Jun. 18, 2019

(54) DISPLAY PANEL, DISPLAY APPARATUS AND DRIVING METHOD THEREOF

(71) Applicant: Xiamen Tianma Micro-Electronics Co., Ltd., Xiamen (CN)

(72) Inventors: Binyi Zheng, Xiamen (CN); Yan Yang, Xiamen (CN); Yongping Zeng, Xiamen (CN); Ling Wu, Xiamen (CN); Boping Shen, Xiamen (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 0 days.

(21) Appl. No.: 15/864,199

(22) Filed: Jan. 8, 2018

(65) Prior Publication Data

US 2018/0130397 A1 May 10, 2018

(30) Foreign Application Priority Data

Sep. 19, 2017 (CN) ..... 2017 1 0848491

(51) Int. Cl.
*G09G 3/20* (2006.01)
*G09G 3/36* (2006.01)

(52) U.S. Cl.
CPC ..... *G09G 3/207* (2013.01); *G09G 3/36* (2013.01); *G09G 2300/0452* (2013.01); *G09G 2310/0232* (2013.01); *G09G 2360/16* (2013.01)

(58) Field of Classification Search
CPC ..... G09G 3/36; G09G 2300/0452; G09G 2360/16; G09G 2310/0232; G09G 2310/0242; G09G 2300/0443; G09G 3/20; G09G 3/3611
See application file for complete search history.

(56) References Cited

U.S. PATENT DOCUMENTS

2016/0189601 A1* 6/2016 Jung ..... G09G 3/20 345/212
2016/0291376 A1* 10/2016 Iwatsu ..... G02F 1/133512
2017/0053582 A1* 2/2017 Hsu ..... G06T 5/003

* cited by examiner

*Primary Examiner* — Md Saiful A Siddiqui
(74) *Attorney, Agent, or Firm* — Anova Law Group, PLLC

(57) ABSTRACT

A display panel, a display apparatus, and a display panel driving method are provided. The display panel comprises a display region including a plurality of pixels arranged in both a first direction and a second direction. The first direction intersects the second direction, and a non-display region surrounding the display region. The display region includes at least one irregular edge intersecting both the first direction and the second direction. The plurality of pixels include a plurality of first pixels intersecting the at least one irregular edge and a plurality of second pixels without intersecting the at least one irregular edge. A first pixel has an initial grayscale g. In a display phase of the display panel, the initial grayscale g of the first pixel is adjusted to a display grayscale G, where G<g.

14 Claims, 14 Drawing Sheets

DISPLAY PANEL, DISPLAY APPARATUS AND DRIVING METHOD THEREOF

CROSS-REFERENCES TO RELATED APPLICATIONS

This application claims the priority of Chinese Patent Application No. 201710848491.9, filed on Sep. 19, 2017, the entire contents of which are incorporated herein by reference.

FIELD OF THE DISCLOSURE

The present disclosure generally relates to the field of display technology and, more particularly, relates to a display panel, a display apparatus, and a driving method thereof.

BACKGROUND

As the display technology advances, user demands become more and more diversified. Existing rectangular-shaped display panels are unable to satisfy more and more diversified user demands for displays and applications. Thus, non-rectangular display panels are gradually emerging as a trend of display technology.

FIG. 1 illustrates a top view of an existing display panel. FIG. 2 illustrates a partially enlarged view of an M region in FIG. 1. As shown in FIG. 1, the display panel includes a display region AA and a non-display region BB. In the display region AA, a plurality of pixels 01 are arranged in an array in both a row direction h and a column direction z. The display region AA includes an irregular-shaped edge L in the boundary. The irregular-shaped edge L is a curved line, which extends in a direction intersecting both the row direction h and the column direction z. When the display panel displays images, ideally the irregular-shaped edge L of the display region AA should be a smooth curved line.

However, as shown in FIG. 2, because each pixel 01 includes a plurality of rectangular-shaped sub-pixels 011 arranged in the row direction h and the column direction z, the irregular edge of the display region AA is actually a jagged image edge L'. When the display panel displays images, the images may appear jagged at the irregular edge L, thereby degrading the display performance.

The disclosed display panel, display apparatus, and driving method thereof are directed to solve one or more problems set forth above and other problems.

BRIEF SUMMARY OF THE DISCLOSURE

One aspect of the present disclosure provides a display panel. The display panel includes a display region including a plurality of pixels arranged in both a first direction and a second direction, wherein the first direction intersects the second direction, and a non-display region surrounding the display region. The display region includes at least one irregular edge intersecting both the first direction and the second direction. The plurality of pixels include a plurality of first pixels intersecting the at least one irregular edge and a plurality of second pixels without intersecting the at least one irregular edge. A first pixel has an initial grayscale g. In a display phase of the display panel, the initial grayscale g of the first pixel is adjusted to a display grayscale G, where G<g.

Another aspect of the present disclosure provides a display apparatus comprising a display panel. The display panel includes a display region including a plurality of pixels arranged in both a first direction and a second direction, wherein the first direction intersects the second direction, and a non-display region surrounding the display region. The display region includes at least one irregular edge intersecting both the first direction and the second direction. The plurality of pixels include a plurality of first pixels intersecting the at least one irregular edge and a plurality of second pixels without intersecting the at least one irregular edge. A first pixel has an initial grayscale g. In a display phase of the display panel, the initial grayscale g of the first pixel is adjusted to a display grayscale G, where G<g.

Another aspect of the present disclosure provides a driving method for a display panel. The display panel includes a display region including a plurality of pixels arranged in both a first direction and a second direction, wherein the first direction intersects the second direction, and a non-display region surrounding the display region. The display region includes at least one irregular edge intersecting both the first direction and the second direction. The plurality of pixels include a plurality of first pixels intersecting the at least one irregular edge and a plurality of second pixels without intersecting the at least one irregular edge. A first pixel has an initial grayscale g. In a display phase of the display panel, the initial grayscale g of the first pixel is adjusted to a display grayscale G, where G<g. The driving method comprises, in the display phase of the display panel, supplying a display voltage signal to each first pixel, such that the first pixel displays light at the display grayscale G, where G<g.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the disclosure, which are illustrated in the accompanying drawings. Wherever possible, the same reference numbers will be used throughout the drawings to refer to the same or like parts. It should be understood that the exemplary embodiments described herein are only intended to illustrate and explain the present invention and not to limit the present invention. In addition, it should also be noted that, for ease of description, only part, but not all, of the structures associated with the present invention are shown in the accompanying drawings. Other embodiments obtained by those skilled in the art without making creative work are within the scope of the present invention.

Figure 1:
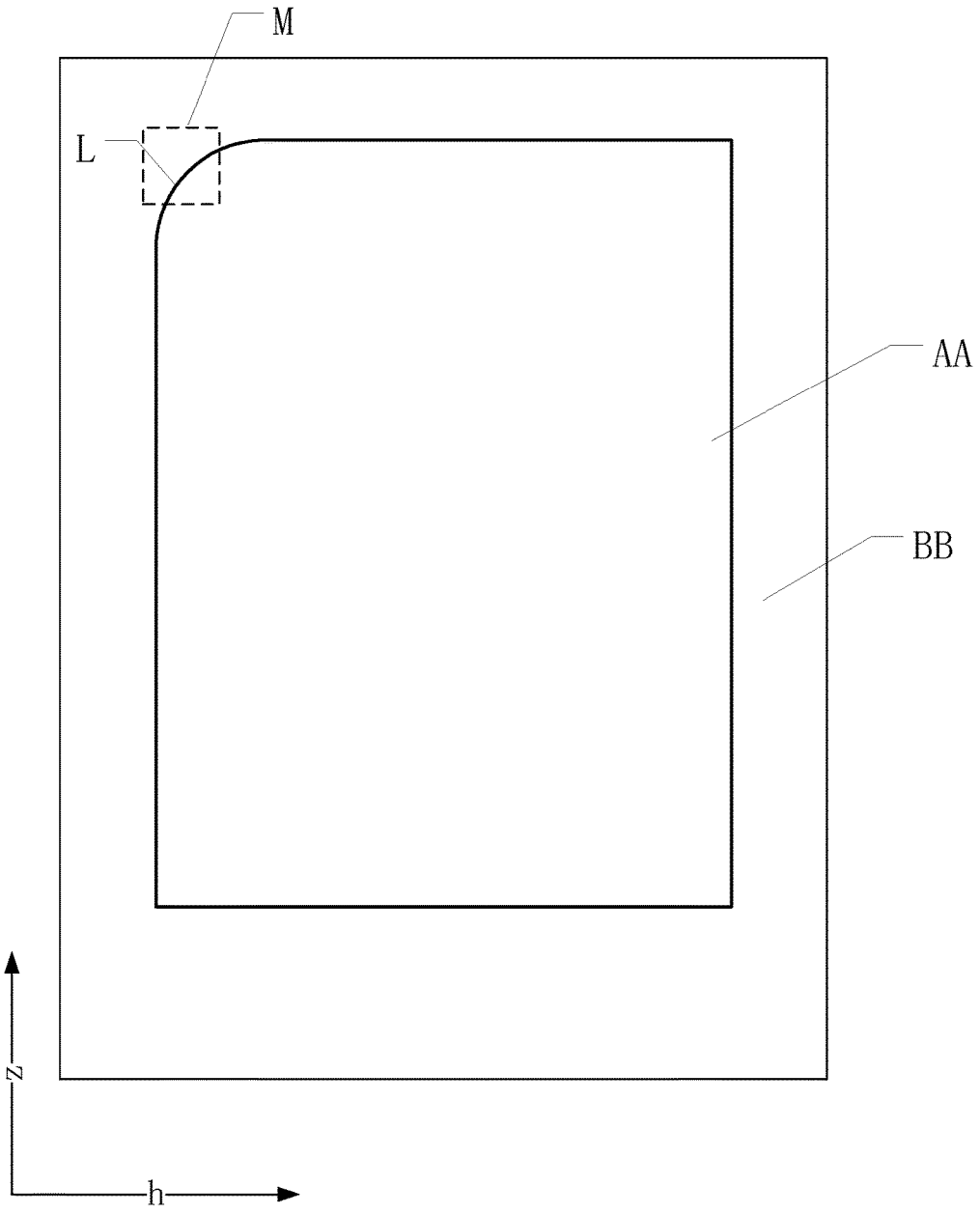
FIG. 1 (Prior Art)
FIG. 1 illustrates a schematic view of an existing display panel.
Figure 2:
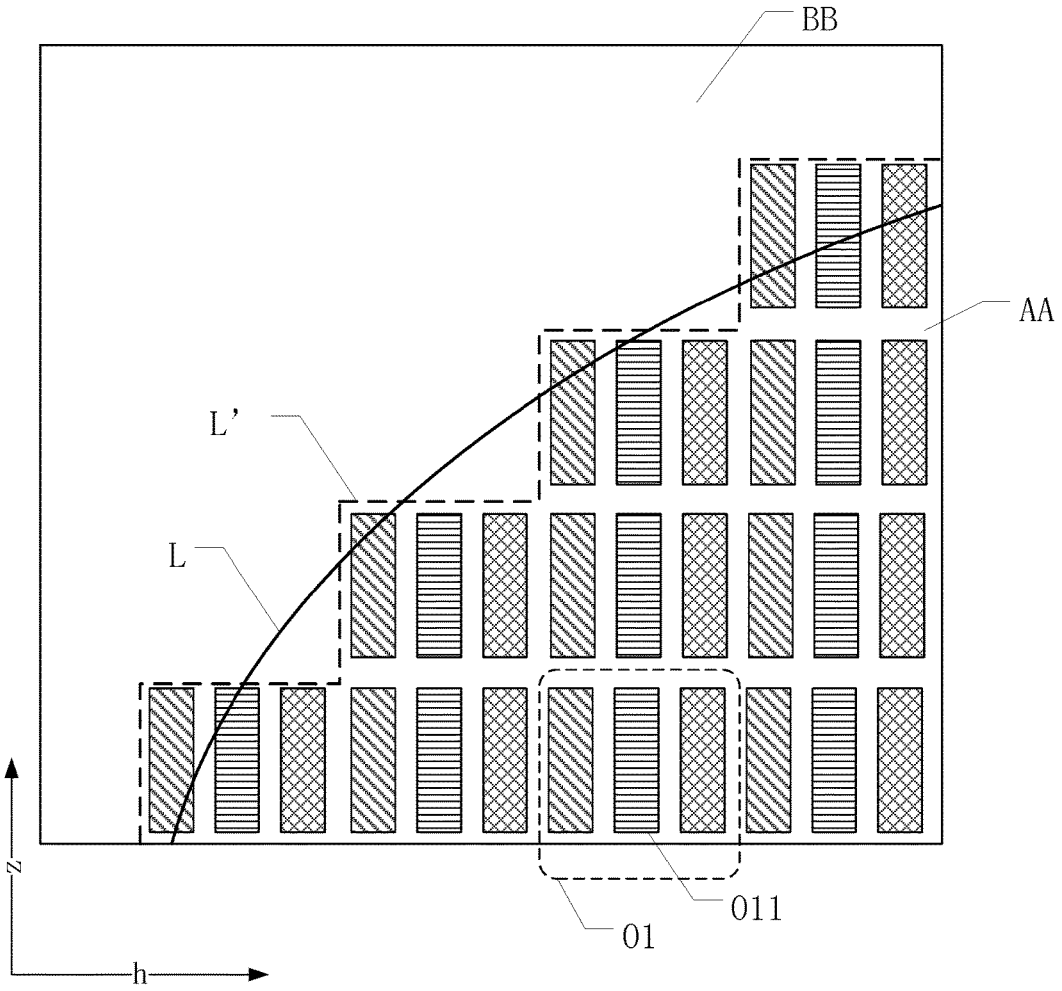
FIG. 2 (Prior Art)
FIG. 2 illustrates a partially enlarged view of an M region in FIG. 1.
Figure 3:
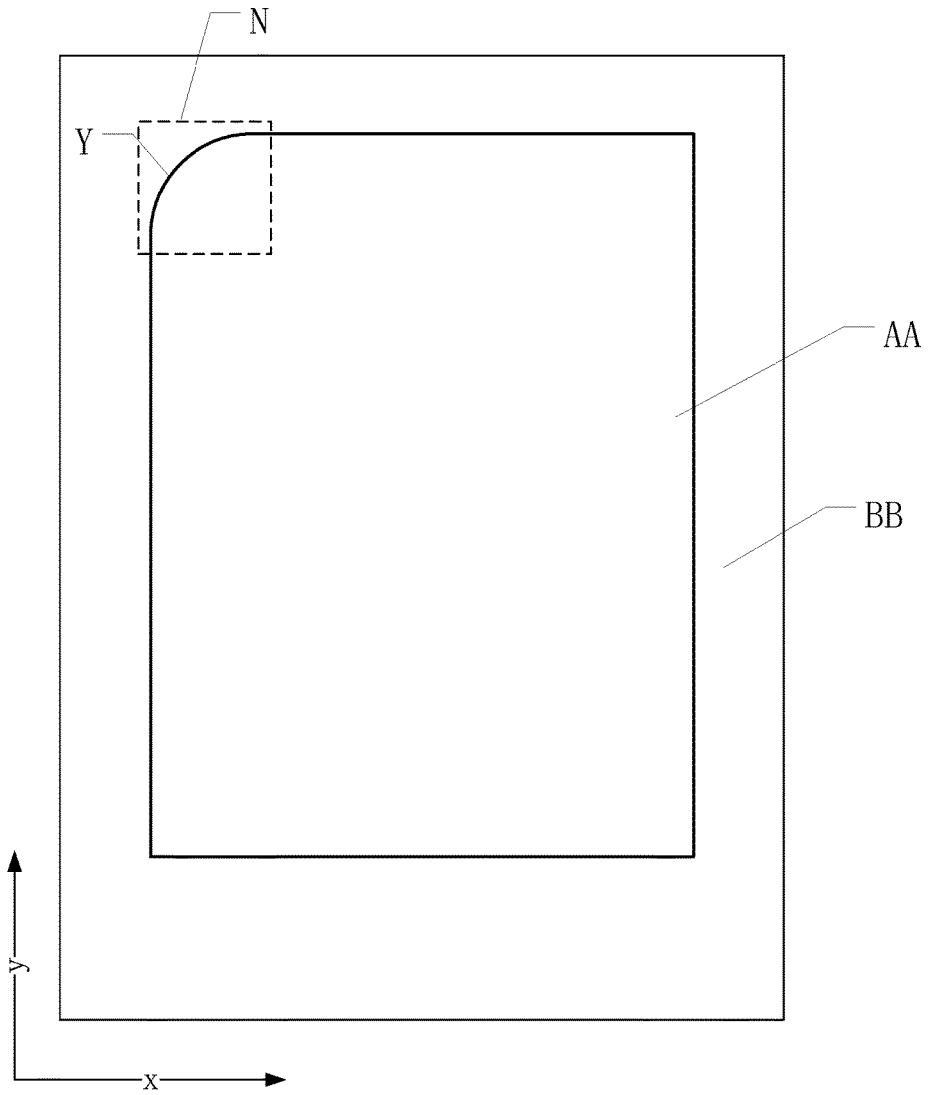
FIG. 3 illustrates a schematic view of an exemplary display panel according to the disclosed embodiments.
Figure 5:
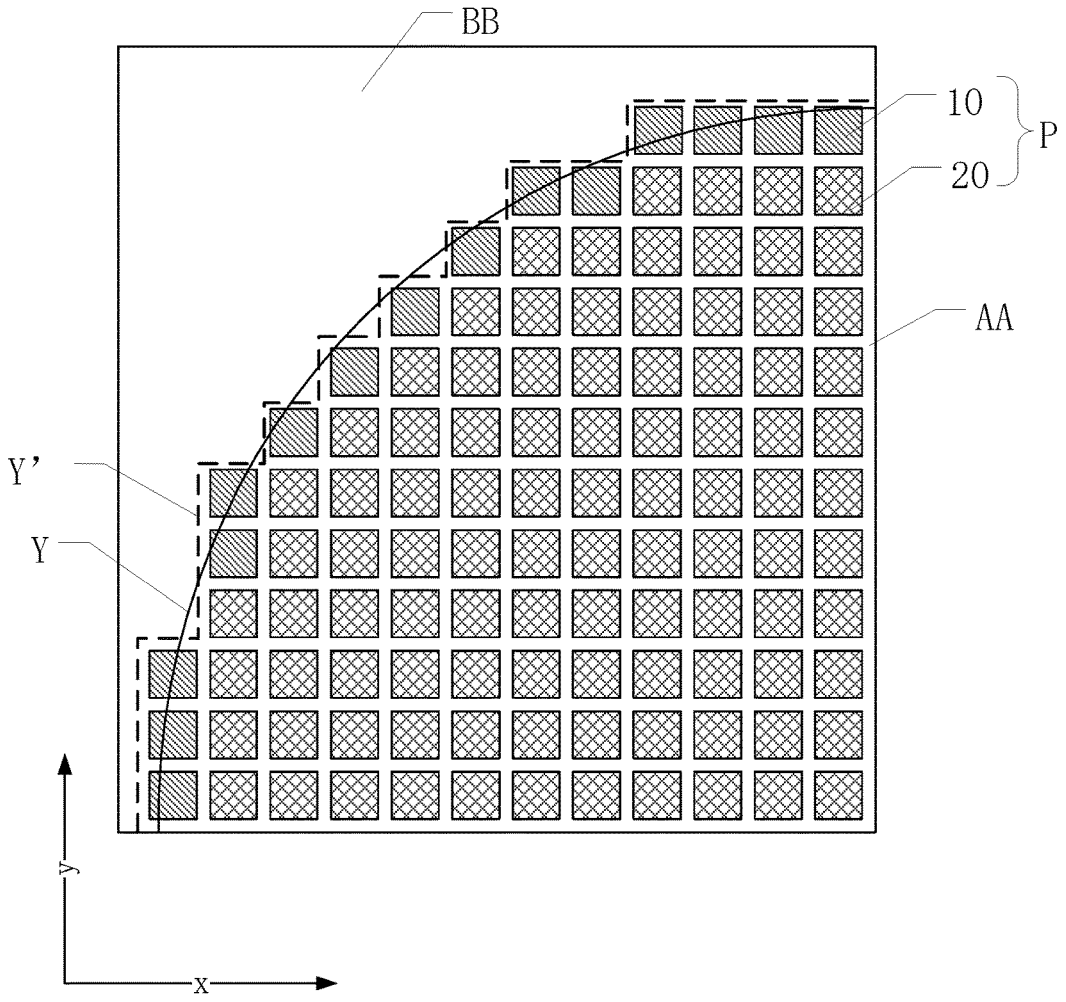
FIG. 5 illustrates a partially enlarged view of an N region in FIG. 3.

The present disclosure provides an improved display panel capable of suppressing the jagged image edge of the display region and improving the display performance. FIG. 3 illustrates a schematic view of an exemplary display panel according to the disclosed embodiments. FIG. 5 illustrates a partially enlarged view of an N region in FIG. 3.

As shown in FIG. 3 and FIG. 5, the display panel may include a display region AA and a non-display region BB. The display region AA may include a plurality of pixels P which are arranged in a first direction x and a second direction y to form a pixel array. The first direction x may intersect the second direction y. The display region AA may include at least one irregular edge Y. The irregular edge Y may extend in a direction intersecting both the first direction x and the second direction y. The plurality of pixels P may include a plurality of first pixels intersecting the irregular edge Y and a plurality of second pixels 20 without intersecting the irregular edge Y. Each first pixel 10 may have an initial grayscale g. In a display phase of the display panel, the initial grayscale g of the first pixel 10 may be adjusted to a display grayscale G of the first pixel 10, where G<g.

In the disclosed embodiments, the display region AA may display images, and may include a plurality of pixels P. The non-display region BB may be arranged surrounding the display region AA, and may include electronic circuit lines, electronic elements, and other appropriate structures. The non-display region BB may not display images. In the disclosed embodiments, each pixel P may include a plurality of sub-pixels. For example, in one embodiment, each pixel P may include three sub-pixels of three different colors, which is intended for illustrative purposes and is not limited by the present disclosure. The plurality of sub-pixels may be defined by a plurality of intersected gate lines and data lines.

Referring to FIG. 3 and FIG. 5, the display region AA may include at least one irregular edge Y. The irregular edge Y may extend in a direction intersecting both the first direction x and the second direction y. In one embodiment, as shown in FIG. 3, the irregular edge Y may be a curved line section/segment. The irregular edge Y may extend in a direction intersecting both the first direction x and the second direction y. In other words, the irregular edge Y may extend in neither the first direction x nor the second direction y.

When the display panel displays images, it is desired that the images appear smoothly at the irregular edge Y of the display region AA. However, in the enlarged view in FIG. 5, the image edge S' actually appears jagged at the boundary of the display region AA. In other words, the jagged image edge S' may appear at the irregular edge Y. In the disclosed embodiments, the irregular edge Y may refer to an irregular edge under ideal circumstances. In particular, in the disclosed display panel, the irregular edge Y may refer to a smooth-curved line section rather than the jagged image edge S'.

Figure 4:
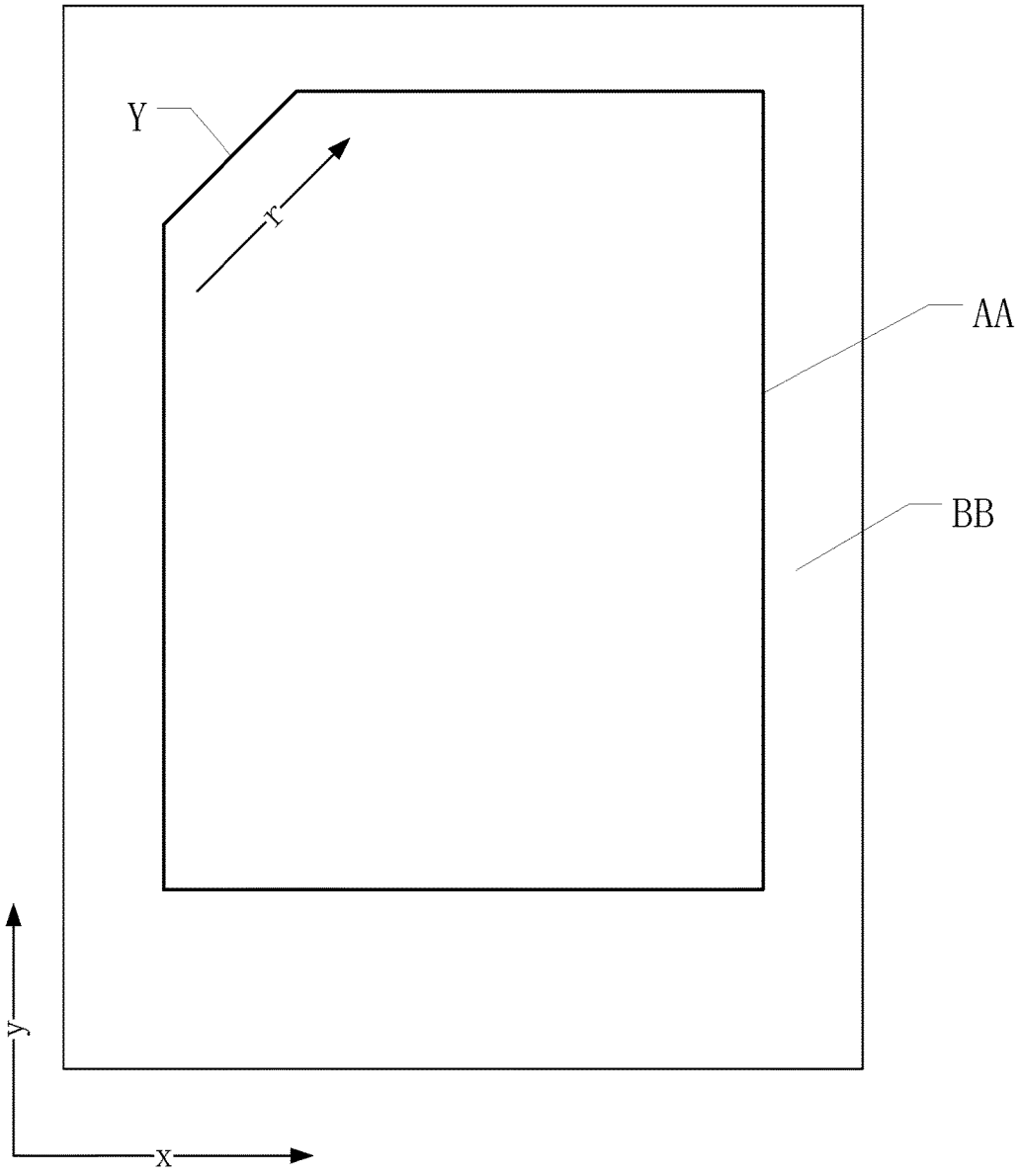
FIG. 4 illustrates a schematic view of another exemplary display panel according to the disclosed embodiments.

In the disclosed display panel, the irregular edge Y may be a curved line section or a sloped line section. The sloped line section may extend in a direction intersecting both the first direction x and the second direction y. In one embodiment, as shown in FIG. 3, the irregular edge Y may be a curved line section. In another embodiment, as shown in FIG. 4, the irregular edge Y may be a sloped line section, extending in a direction intersecting both the first direction x and the second direction y. The first direction x may intersect the second direction y. In one embodiment, the first direction x may be perpendicular to the second direction y.

Referring to FIG. 3 and FIG. 5, the plurality of pixels P may include a plurality of first pixels 10 and a plurality of second pixels 20. The first pixels may intersect the irregular edge Y. That is, the irregular edge Y may pass through an area where the first pixels are disposed.

When the display panel is displaying an image, each of the plurality of the pixels in the display panel may receive an electrical signal. Based on the received electrical signal, each pixel may exhibit corresponding brightness and color and, accordingly, the plurality of pixels may form an image. The brightness displayed by each pixel may be denoted as a grayscale of the pixel. In the existing display panel, a first pixel may receive an electrical signal which is not subject to any grayscale adjustment. For example, when the existing display panel is displaying image, there may be a displayed image in which a plurality of pixels having the grayscale of 255 are disposed in the area adjacent to the irregular edge. Thus, the plurality of the first pixels may receive the electrical signals and exhibit corresponding brightness having the grayscale of 255. Because the irregular edge intersects the plurality of the first pixels, without any brightness adjustment, the image edge may appear severely jagged at the irregular edge.

In the disclosed embodiments, the first pixel 10 may have an initial grayscale g. The initial grayscale g may be defined as follows. For example, the display panel is displaying an image A. Without adjusting brightness for the pixels forming the image A, the corresponding brightness of each first pixel 10 may be the initial grayscale g. In the disclosed embodiments, the brightness corresponding to the first pixels 10 may be adjusted. In the display phase of the display panel, the grayscale of the first pixel 10 may be adjusted, such that the grayscale of the first pixel 10 may be adjusted to be a display grayscale G, where G<g. In other words, in the disclosed display panel, the first pixel 10 may actually display a brightness corresponding to the display grayscale G.

Accordingly, the display panel may actually display an image A'. The difference between the image A and the image A' may be the brightness of the first pixels 10. For example, the brightness of the first pixels 10 in the image A' may be reduced. Because the non-display region BB is often shielded by a black matrix, the pixels disposed in the non-display region BB may have substantially small grayscales. When the display grayscales G of the first pixels 10 decrease and approach the grayscales of the pixels in the non-display region BB, the first pixels 10 may become more and more unlikely to be recognized by human eyes. In the disclosed display panel, the first pixel 10 grayscale may be adjusted to be the display grayscale G to suppress the visual recognition of the first pixel 10 by human eyes. Thus, compared to the existing display panel, the jagged image edge at the irregular edge Y in the disclosed display panel may be suppressed.

In the disclosed embodiments, the display region may include at least one irregular edge. The pixels intersecting the at least one irregular edge may be the first pixels. Each first pixel may have the initial grayscale g. In the display phase, the initial grayscale g of the first pixel may be adjusted to the display grayscale G, where G<g. Because the display grayscale of the first pixel is reduced in the display phase, the jagged image edge at the irregular edge may be suppressed, and the display performance may be improved accordingly.

Figure 6:
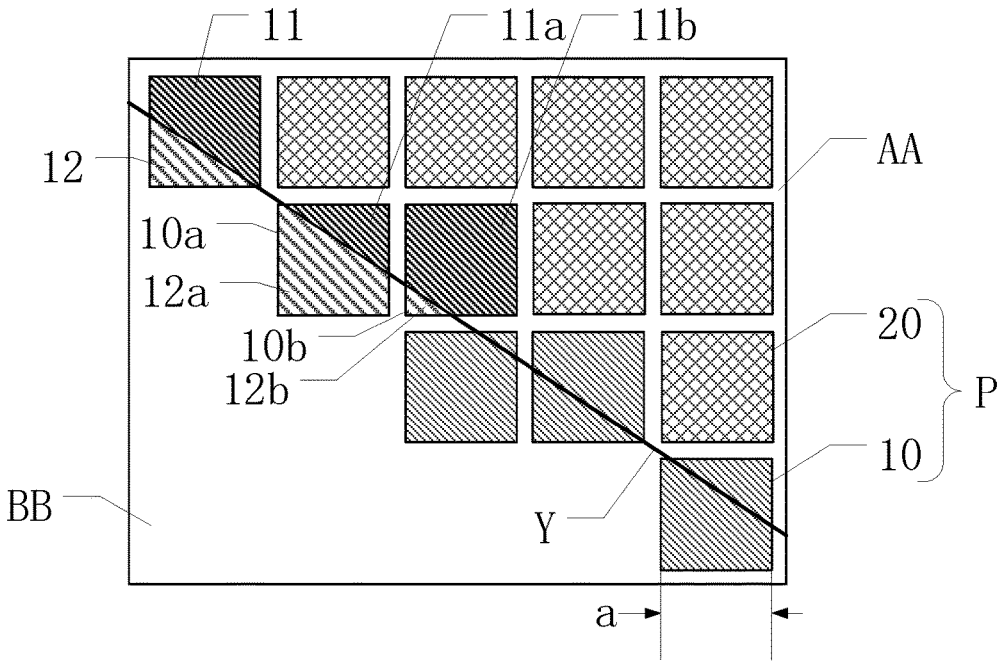
FIG. 6 illustrates a partial view of another exemplary display panel according to the disclosed embodiments.

FIG. 6 illustrates a partial view of another exemplary display panel according to the disclosed embodiments. The similarities between FIG. 6 and FIG. 5 are not repeated, while certain difference may be explained.

As shown in FIG. 6, each first pixel 10 may be divided by the irregular edge Y into a first region 11 and a second region 12. The irregular edge Y may have a first side adjacent to the display region AA and a second side far away from the display region AA. The first region 11 may be disposed on the first side of the irregular edge Y, i.e., the side adjacent to the display region AA. The second region 12 may be disposed on the second side of the irregular edge Y, i.e., the side far away from the display region AA. Then, S*g=G*SP, where SP is an area size of the first pixel 10, and S is an area size of the first region 11 of the first pixel 10. In the disclosed display panel, the display grayscale G of each first pixel 10 may be related to the area size SP of the first pixel 10, the area size S of the first region 11 in the first pixel 10, and the initial grayscale g of the first pixel 10. Because SP, S, and g are known, based on the equation S*g=G*SP, G may be obtained by calculation.

In the disclosed display panel, the first pixels 10 each may have the identical area size SP. On one hand, at the irregular edge Y, when the plurality of the first pixels 10 have the identical initial grayscale g, and the first region 11 has a larger area size S and the second region 12 may have a smaller area size accordingly, the display grayscale G of the corresponding first pixel 10 may be higher. On the other hand, at the irregular edge Y, when the plurality of the first pixels 10 have the identical initial grayscale g, and the first region 11 has a smaller area size S and the second region 12 has a larger area size accordingly, the display grayscale G of the corresponding first pixel 10 may be lower.

For example, as shown in FIG. 6, a first pixel 10*a* may intersect the irregular edge Y, and may be divided by the irregular edge Y into a first region 11*a* and a second region 12*a*. A first pixel 10*b* may intersect the irregular edge Y, and may be divided by the irregular edge Y into a first region 11*b* and a second region 12*b*. The first region 11*a* of the first pixel 10*a* may be smaller than the first region 11*b* of the first pixel 10*b*. When the first pixel 10*a* and the first pixel 10*b* have the identical size and the identical initial grayscale g, the display grayscale G of the first pixel 10*a* may be lower than the display grayscale G of the first pixel 10*b*.

In the first pixel 10*a* and the first pixel 10*b*, the first pixel 10*a* may have a larger portion disposed in the non-display region BB, and the first pixel 10*b* may have a smaller portion disposed in the non-display region BB. That is, the second region 12*a* of the first pixel 10*a* may be larger than the second region 12*b* of the first pixel 10*b*. When the second region 12*a* of the first pixel 10*a* is larger than the second region 12*b* of the first pixel 10*b*, the first pixel 10*a* may protrude more from the display region AA into the non-display region BB, and the jagged edge may look more obvious at the first pixel 10*a*, as compared to the first pixel 10*b*. Through configuring the display grayscale G of the first pixel 10*a* to be smaller than the display grayscale G of the first pixel 10*b*, the jagged edge at the first pixel 10*a* may be suppressed.

In the disclosed embodiments, the display grayscale G of the first pixel 10 may be correlated with the size of the first region 11. When the first region 11 is smaller, the display grayscale G of the corresponding first pixel 10 may be lower. Based on the specific situation that the first pixel 10 intersects the irregular edge Y (i.e., the area sizes of the first region and second region), the display grayscale G of the first pixel 10 may be configured accordingly to suppress the jagged image edge at the irregular edge Y.

In certain embodiments, referring to FIG. 6, the first pixel 10 may be a square having a side a, and $SP=a^2$. In certain other embodiments, all the pixels in the display panel may be squares having a side a.

Figure 7:
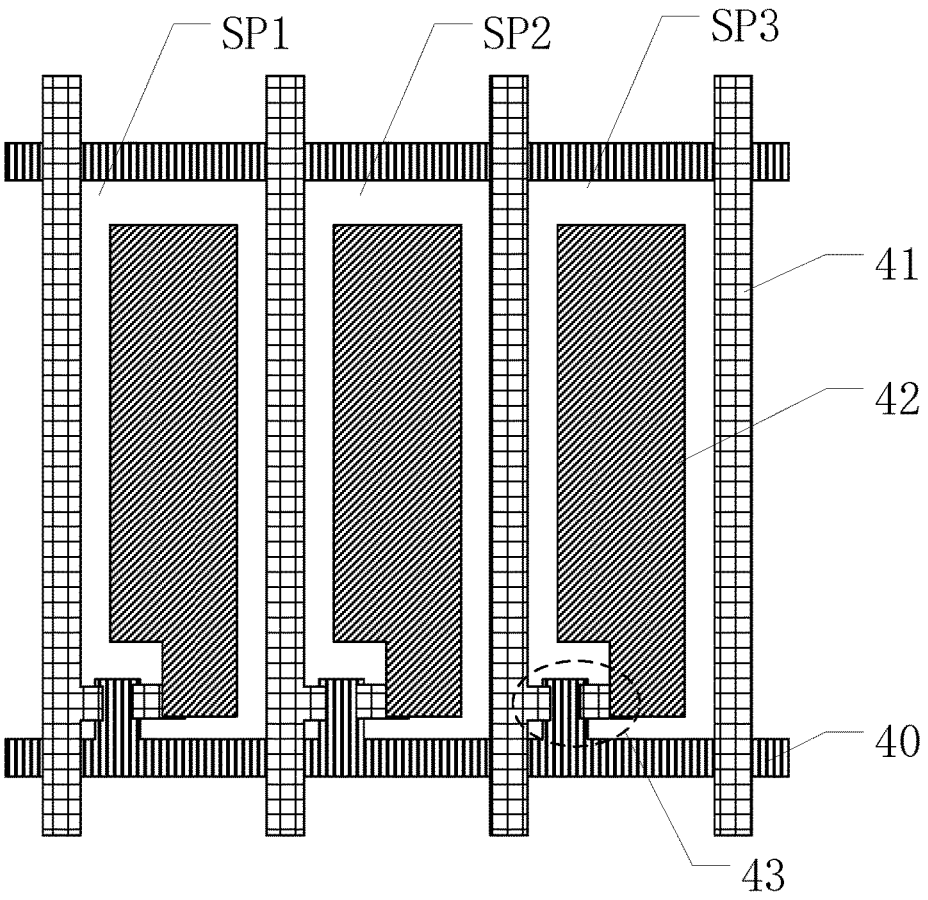
FIG. 7 illustrates a schematic view of an exemplary pixel in an exemplary display panel according to the disclosed embodiments.

FIG. 7 illustrates a schematic view of an exemplary pixel in an exemplary display panel according to the disclosed embodiments. In one embodiment, as shown in FIG. 7, the pixel may include a first color sub-pixel SP1, a second color sub-pixel SP2, and a third color sub-pixel SP3. One pixel may include three sub-pixels. A plurality of gate lines 40 and a plurality of data lines 41 may insulatively intersect to define the sub-pixels. Each sub-pixel may also include a pixel electrode 42. The display panel may also include a plurality of thin-film-transistors 43 (TFT). The TFT 43 may be electrically connected to a corresponding pixel electrode 42 to drive the pixel electrode 42. The display panel may also include other well-known structures which are not explained here.

In particular, the TFT 43 may include a gate electrode, a source electrode, and a drain electrode. The gate electrode of the TFT 43 may be electrically connected to a corresponding gate line 40. The source electrode of the TFT 43 may be electrically connected to a corresponding data line 41. The drain electrode of the TFT 43 may be electrically connected to a corresponding pixel electrode 42. In the pixel, three sub-pixels may have three different colors. For example, the first color sub-pixel SP1 may be red, the second color sub-pixel SP2 may be green, and the third color sub-pixel SP3 may be blue, which is intended for illustrative purposes and is not limited by the present disclosure.

The display panel may be a plasma display panel, a field emission display panel, a light-emitting diode (LED) display panel, an organic light-emitting diode (OLED) display panel, a liquid crystal display panel, a quantum dots (QDs) display panel, an electrophoretic display panel, etc. Further, the display panel may include any appropriate type of display panels capable of display images and/or videos.

In one embodiment, referring to FIG. 7, when the display panel is a LCD display panel, a color resist layer may be configured in the display panel. Three color resists of three different colors may be configured in the color resist layer, such that the three sub-pixels in the pixel may have three different colors. When the display panel is an OLED display panel, light emitting material emitting light of different colors may be configured in a light emitting layer of the display panel, such that the three sub-pixels in the pixel may have three different colors. In certain other embodiments, the display panel may be micro light emitting diode (micro LED) display panel or other appropriate display panels, which is determined according to the actual application scenario and is not limited by the present disclosure.

Figure 8:
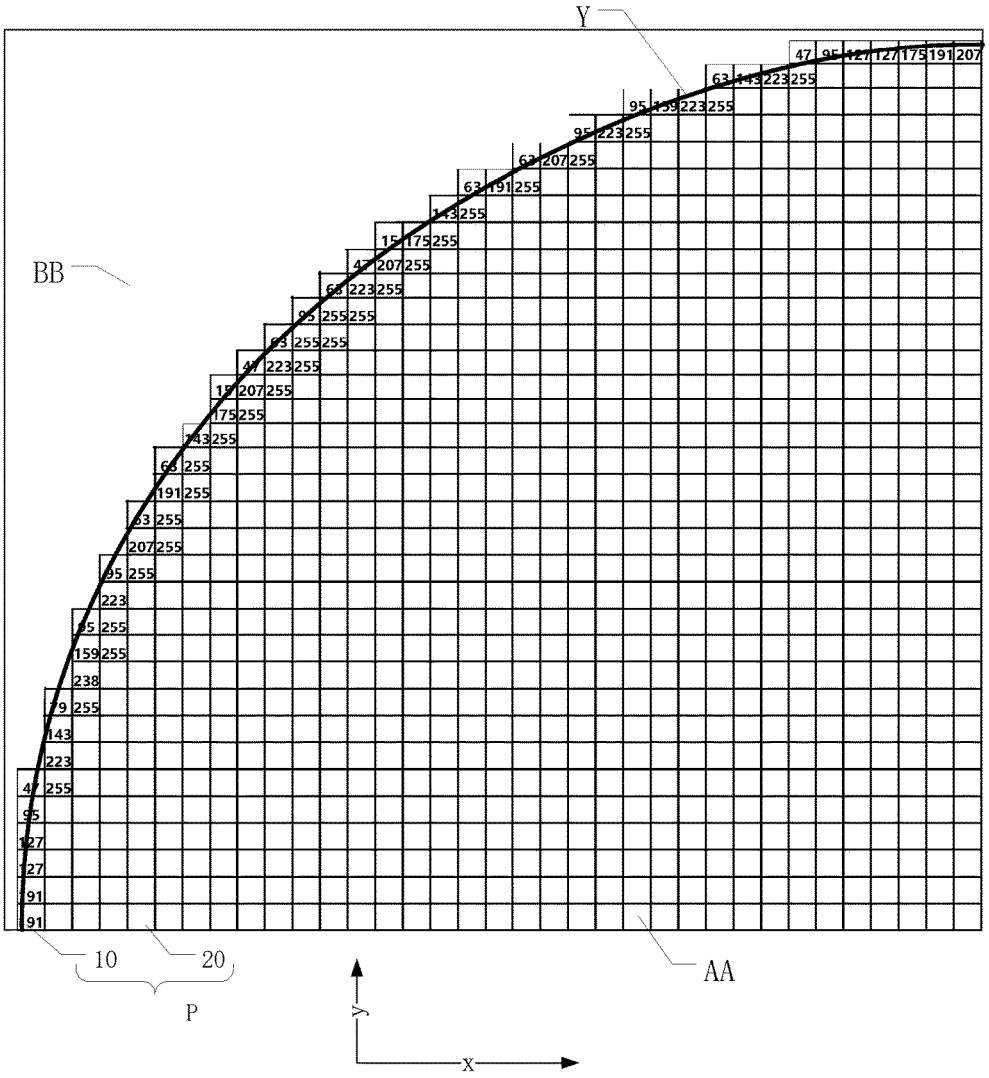
FIG. 8 illustrates a partial view of another exemplary display panel according to the disclosed embodiments.

FIG. 8 illustrates a partial view of another exemplary display panel according to the disclosed embodiments. The similarities between FIG. 8 and FIG. 5 are not repeated, while certain difference may be explained. For illustrative purposes, pixels P are represented by squares in FIG. 8.

As shown in FIG. 8, the irregular edge Y may be an arc, having a radius R. Compared to the rectangular display region in the existing display panel, in the disclosed display panel, the right-angled corners may be replaced by the arc-shaped rounded corners, such that the display performance may look more desirable and may enhance user experience.

Figure 9:
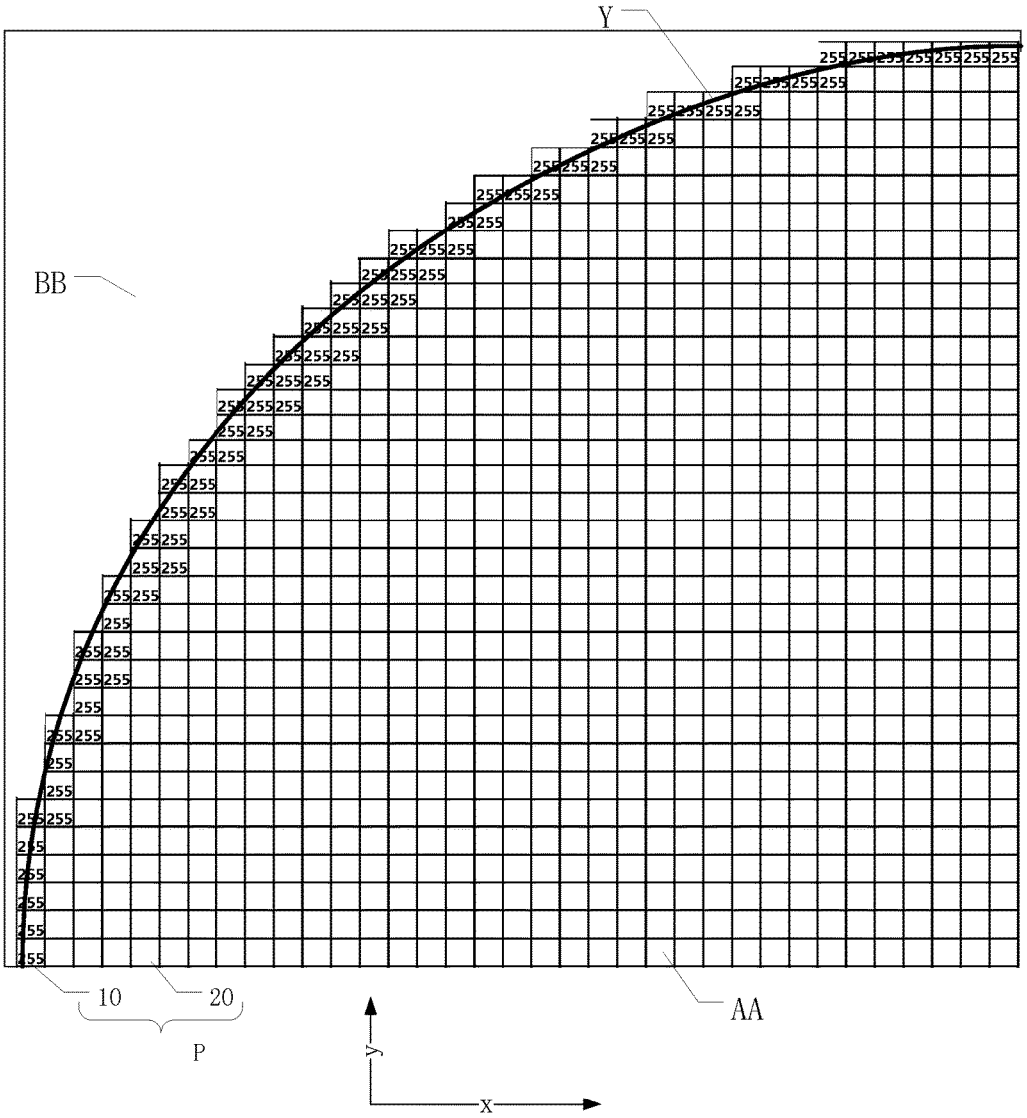
FIG. 9 (Prior Art)
FIG. 9 illustrates a partial view of an existing display panel.

FIG. 9 illustrates a partial view of an existing display panel. FIG. 9 is a counterpart of the disclosed display panel shown in FIG. 8. In the display panels shown in both FIG. 8 and FIG. 9, the irregular edge Y is an arc having a radius R, and the side of each pixel has an identical size.

Different from the display panel shown in FIG. 9, in the disclosed display panel shown in FIG. 8, an initial grayscale g of each first pixel 10 may be configured to 255. However, after the adjustment, each first pixel 10 may have an actual display grayscale G. As a comparison, as shown in FIG. 9, no brightness adjustment may be performed on the first pixels 10, and all first pixels 10 may have the grayscale of 255.

In the disclosed display panel shown in FIG. 8, based on the specific situation that each first pixel 10 intersects the irregular edge Y, the display grayscale G for the corresponding first pixel 10 may be obtained by calculation. The numbers marked in each first pixel 10 may be the display grayscale for a specific first pixel 10. The pixels P without any marked number may have the same grayscale 255.

In the existing display panel shown in FIG. 9, an obvious jagged image edge may be observed at the irregular edge Y. In the disclosed display panel shown in FIG. 8, the jagged image edge may be substantially suppressed at the irregular edge Y. Compared to the display panel in FIG. 9, in the display panel in FIG. 8, the jagged image edge may be effectively suppressed at the irregular edge Y.

Figure 10:
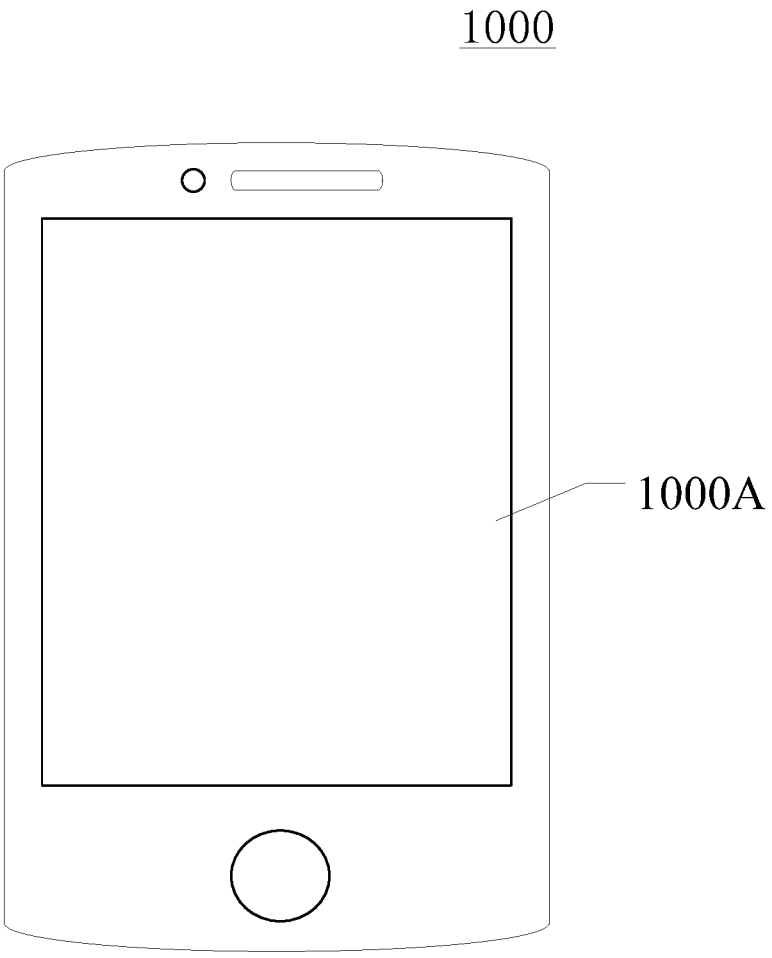
FIG. 10 illustrates a schematic view of an exemplary display apparatus according to the disclosed embodiments.

The present disclosure also provides a display apparatus, comprising any one of the disclosed display panels. FIG. 10 illustrates a schematic view of an exemplary display apparatus according to the disclosed embodiments. As shown in FIG. 10, the display apparatus 1000 may include any one of the disclosed display panels 1000A. For illustrative purposes, a smart phone is shown in FIG. 10. The display apparatus 1000 may be a computer, a television set, a vehicle-mounted display device, or other display device having the display function, which is not limited by the present disclosure. The disclosed display apparatus may have the features and functions of the disclosed display panel. The detail description of the features and functions may refer to various embodiments of the disclosed display panels, and will not be repeated herein.

Figure 11:
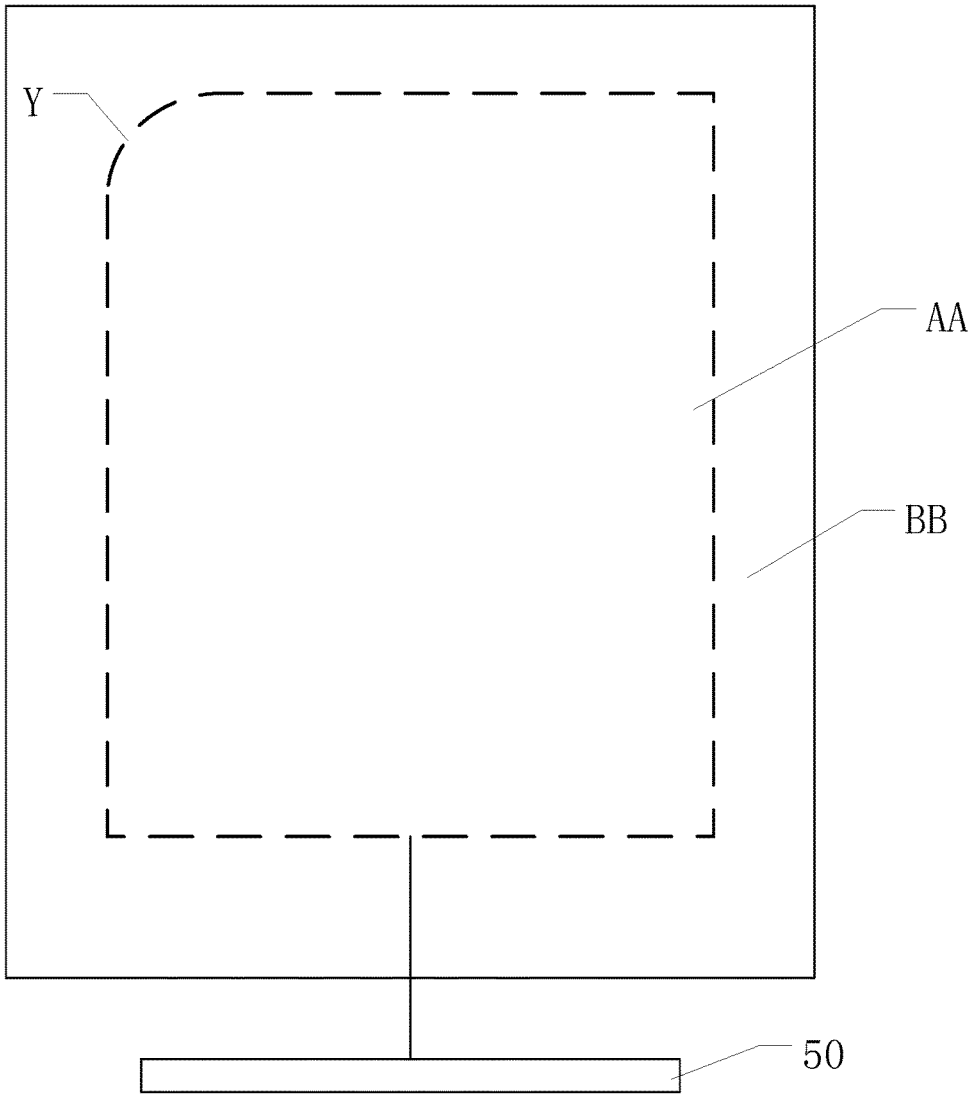
FIG. 11 illustrates a schematic view of another exemplary display apparatus according to the disclosed embodiments.

FIG. 11 illustrates a schematic view of another exemplary display apparatus according to the disclosed embodiments. In certain embodiments, referring to FIG. 5 and FIG. 11, the display apparatus may include a chip 50. The chip 50 may be configured to supply display voltage signals to the first pixels 10, thereby controlling each first pixel 10 to exhibit the corresponding display grayscale G.

In the display apparatus, the chip 50 may be electrically connected to the display panel to supply the display voltage signals to the first pixels 10. Each first pixel 10 may receive the corresponding display voltage signal and may display the grayscale accordingly. In one embodiment, the chip 50 may be bonded to the display panel. In another embodiment, the chip 50 may be disposed in any other location of the display apparatus, which is not limited by the present disclosure.

Figure 12:
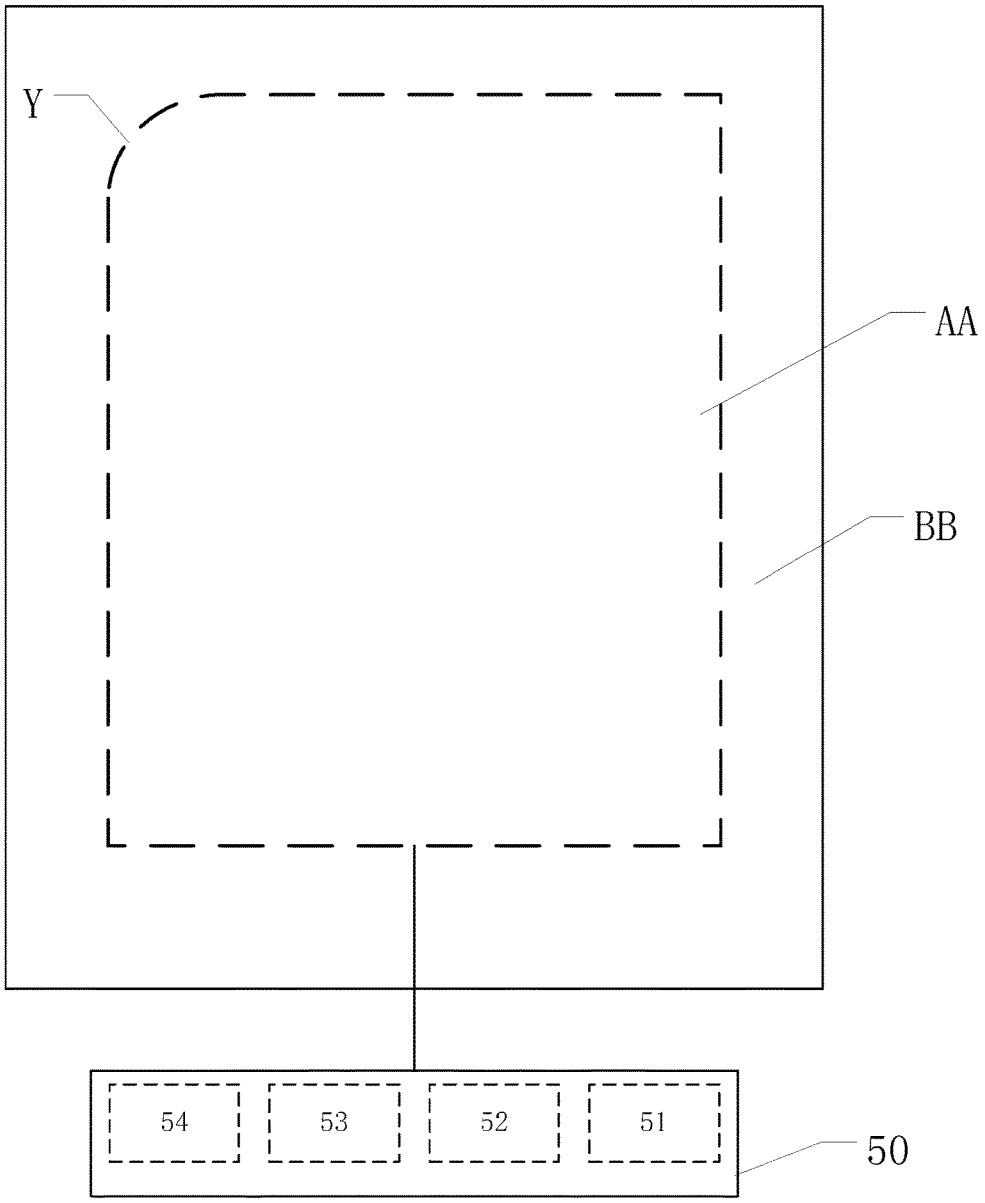
FIG. 12 illustrates a schematic view of another exemplary display apparatus according to the disclosed embodiments.

FIG. 12 illustrates a schematic view of another exemplary display apparatus according to the disclosed embodiments. The similarities between FIG. 12 and FIG. 11 are not repeated, while certain difference may be explained.

In certain embodiments, referring to FIG. 5 and FIG. 12, the chip 50 may include a voltage conversion module 51. The voltage conversion module 51 may convert the display grayscale G into a corresponding display voltage signal. In one embodiment, the voltage conversion module 51 may include a pre-configured calculation equation. Based on the display grayscale G, the corresponding display voltage signal may be obtained through calculation. The chip 50 may supply the display voltage signal to the corresponding first pixel 10, and the first pixel 10 may exhibit the brightness corresponding to the display grayscale G.

In certain other embodiments, referring to FIG. 6 and FIG. 12, the chip 50 may further include a grayscale calculation module 52. Based on the initial grayscale g of a first pixel 10, the area size SP of the first pixel 10, and the area size S of the first region 11, the equation $S*g=G*SP$ may be used to obtain the display grayscale G for the first pixel 10. In one embodiment, the grayscale calculation module 52 may be configured in the chip 50 to calculate the display grayscale G for each first pixel 10 in each image.

In certain other embodiments, referring to FIG. 6 and FIG. 12, the chip 50 may further include an image information retrieval module 53. The image information retrieval module 53 may be configured to retrieve the image information for the current image frame. The disclosed display apparatus may display a plurality of image frames in one second. In one embodiment, for example, 60 image frames may be displayed, and the image information retrieval module 53 may be configured to retrieve the image information for the current image frame. In particular, the image information retrieval module 53 may retrieve at least the initial grayscale g for each pixel in the current image frame.

In certain other embodiments, referring to FIG. 6 and FIG. 12, the chip 50 may further include an image information processing module 54. The image information processing module 54 may be configured to analyze the image information to obtain the initial grayscales g of the first pixel 10, the area size SP of the first pixel 10, and the area size S of the first region. The image information processing module 54 may obtain the initial grayscale g of each first pixel 10.

In one embodiment, after the display apparatus is fabricated, the area size SP of each first pixel 10 may be fixed. Moreover, the irregular edge Y may also be fixed. Thus, the area size S of the first region 11 in each first pixel 10 may be fixed as well. The area size SP of each first pixel 10 and the area size S of the first region 11 in each first pixel 10 may be pre-configured in the image information processing module 54. Then the image information processing module 54 may only be desired to obtain the initial grayscale g for each first pixel 10 in each image frame.

In one embodiment, in the display apparatus shown in FIG. 12, the voltage conversion module 51, the grayscale calculation module 52, the image information retrieval module 53, and the image information processing module 54 may be configured in the same chip 50. In another embodiment, the display apparatus may include more than one chip. The voltage conversion module 51, the grayscale calculation module 52, the image information retrieval module 53, and the image information processing module 54 may be configured separately in different chips. An exemplary structure is shown in FIG. 13.

Figure 13:
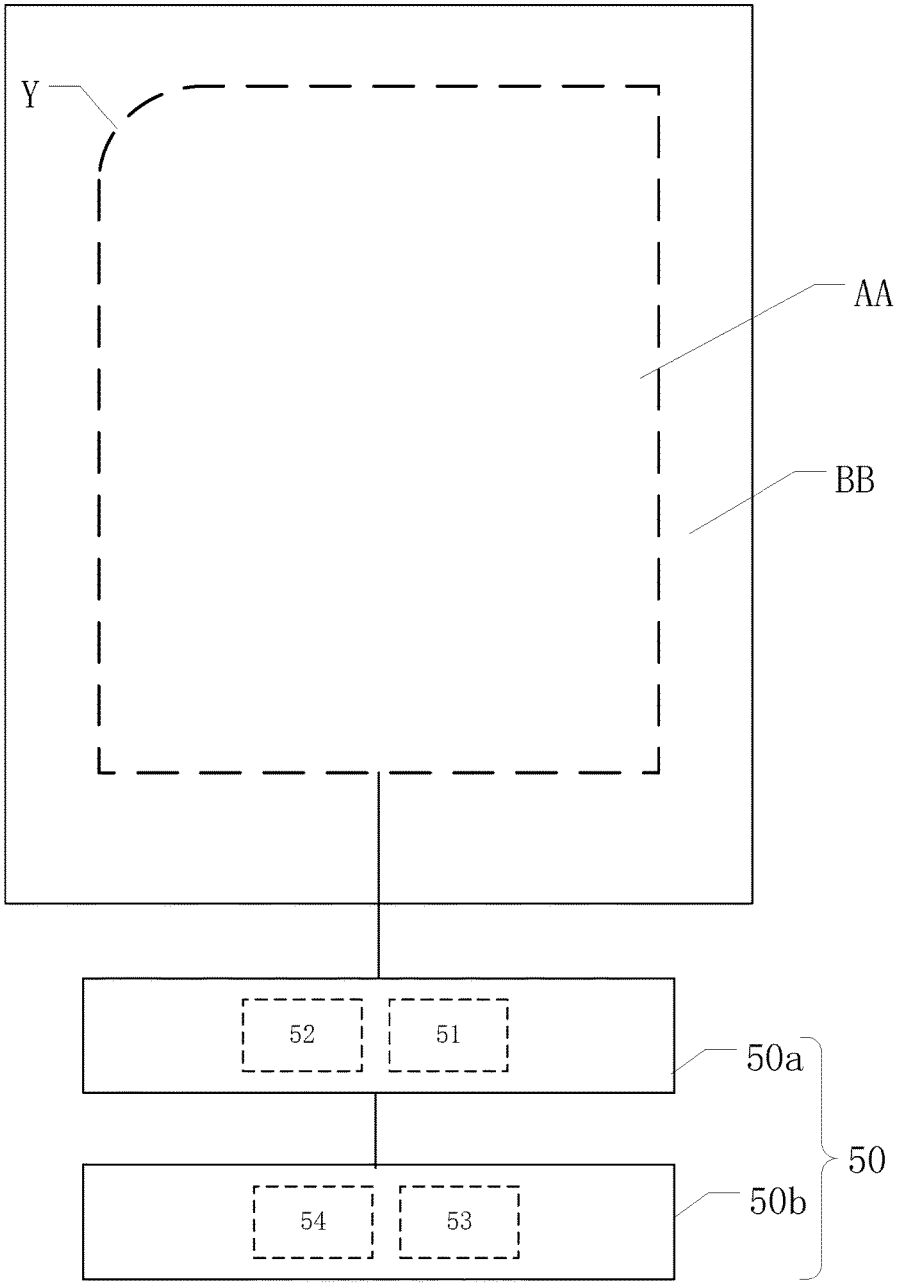
FIG. 13 illustrates a schematic view of another exemplary display apparatus according to the disclosed embodiments.

FIG. 13 illustrates a schematic view of another exemplary display apparatus according to the disclosed embodiments. Different from the display apparatus shown in FIG. 12, the display apparatus shown in FIG. 13 may include a chip 50*a* and a chip 50*b*. The voltage conversion module 51 and the grayscale calculation module 52 may be configured in the chip 50*a*. The image information retrieval module 53 and the information processing module 54 may be configured in the chip 50*b*.

In particular applications, the chips where the voltage conversion module 51, the grayscale calculation module 52, the information retrieval module 53, and the information processing module 54 are disposed in may be determined according to various application scenarios, which are not limited by the present disclosure.

The present disclosure further provides a display panel driving method. Referring to FIG. 3 and FIG. 5, the display panel may include a display region AA and a non-display region BB surrounding the display region AA. The display region AA may include a plurality of pixels P arranged in a first direction x and a second direction y to form an array. The first direction x may intersect the second direction y. The display region AA may include at least one irregular edge Y, which extends in neither the first direction x nor the second direction y. The plurality of pixels P may include a plurality of first pixels 10 intersecting the irregular edge Y and a plurality of second pixels 20 without intersecting the irregular edge Y. Each first pixel 10 may have an initial grayscale g.

In one embodiment, the driving method may include the following steps. In a display phase of the display panel, a display voltage signal may be supplied to each first pixel 10, such that the first pixel 10 may have a display grayscale G, where G>g. In the display panel driving method, each first pixel 10 may have the initial grayscale g. The initial grayscale g may be defined as follows. For example, when the display panel is displaying an image A, without adjusting brightness for the pixels forming the image A, the corresponding brightness of each first pixel 10 may be the initial grayscale g. In the disclosed embodiments, the brightness corresponding to each first pixel 10 may be adjusted. In the display phase of the display panel, the grayscale of each first pixel 10 may be adjusted, such that the grayscale of the first pixel 10 may be configured to be the display grayscale G, where G<g. In other words, in the disclosed embodiments, each first pixel 10 may actually exhibit a brightness corresponding to the display grayscale G.

The display panel may actually display an image A'. The difference between the image A and the image A' may be the brightness of the first pixels 10. The brightness of each first pixel 10 in the image A' may be reduced. Because the non-display region BB is often shielded by the black matrix, the pixels disposed in the non-display region BB may have substantially small grayscales. When the display grayscale G of the first pixel 10 decreases and approaches the grayscale of the pixels in the non-display region BB, the first pixel 10 may become more and more unlikely to be recognized by human eyes.

In the disclosed embodiments, the display voltage signal may be supplied to each first pixel 10, such that the grayscale of each first pixel 10 may be adjusted to be the display grayscale G to suppress the visual recognition of the first pixel 10 by human eyes. Thus, compared to the existing display panel, the jagged image edge at the irregular edge Y of the disclosed display panel may be suppressed.

In certain embodiments, referring to FIG. 6, the first pixel 10 may be divided by the irregular edge Y into a first region 11 and a second region 12. The irregular edge Y may have a first side adjacent to the display region AA and a second side far away from the display region AA. The first region 11 may be disposed on the first side of the irregular edge Y, i.e., the side adjacent to the display region AA. The second region 12 may be disposed on the second side of the irregular edge Y, i.e., the side far away from the display region AA. Then, S*g=G*SP, where SP is an area size of the first pixel 10, and S is an area size of the first region 11 of the first pixel 10. In the display panel according to the disclosed embodiments, the display grayscale G of a first pixel 10 may be related to the area size SP of the first pixel 10, the area size S of the first region 11 of the first pixel 10, and the initial grayscale g of the first pixel 10. Because SP, S, and g are known, based on the equation S*g=G*SP, G may be obtained by calculation In the disclosed embodiments, the first pixels 10 each may have the identical area size SP. On one hand, at the irregular edge Y, when the plurality of the first pixels 10 have the identical initial grayscale g, and the first region 11 has a larger area size S, and the second region 12 has a smaller area size accordingly, the display grayscale G of the corresponding first pixel 10 may be higher. On the other hand, at the irregular edge Y, when the plurality of the first pixels 10 have the identical initial grayscale g, and the first region 11 has a smaller area size S and the second region 12 has a larger area size accordingly, the display grayscale G of the corresponding first pixel 10 may be lower.

For example, as shown in FIG. 6, a first pixel 10*a* may intersect the irregular edge Y, and may be divided by the irregular edge Y into a first region 11*a* and a second region 12*a*. A first pixel 10*b* may intersect the irregular edge Y, and may be divided by the irregular edge Y into a first region 11*b* and a second region 12*b*. The first region 11*a* of the first pixel 10*a* may be smaller than the first region 11*b* of the first pixel 10*b*. When the first pixel 10*a* and the first pixel 10*b* have the identical size and the identical initial grayscale g, the display grayscale G of the first pixel 10*a* may be lower than the display grayscale G of the first pixel 10*b*.

In the first pixel 10*a* and the first pixel 10*b*, the first pixel 10*a* may have a larger portion disposed in the non-display region BB, and the first pixel 10*b* may have a smaller portion disposed in the non-display region BB. That is, the second region 12*a* of the first pixel 10*a* may be larger than the second region 12*b* of the first pixel 10*b*. When the second region 12*a* of the first pixel 10*a* is larger than the second region 12*b* of the first pixel 10*b*, the first pixel 10*a* may protrude more from the display region AA into the non-display region BB, and the jagged edge may look more obvious at the first pixel 10*a*, as compared to the first pixel 10*b*. Through configuring the display grayscale G of the first pixel 10*a* to be smaller than the display grayscale G of the first pixel 10*b*, the jagged edge at the first pixel 10*a* may be suppressed.

In the disclosed embodiments, the display grayscale G of the first pixel 10 may be correlated with the size of the first region 11. When the first region 11 is smaller, the display grayscale G of the corresponding first pixel 10 may be lower. Based on the specific situation that the first pixel 10 intersects the irregular edge Y (i.e., the area sizes of the first region and the second region), the display grayscale G of the first pixel 10 may be configured accordingly to suppress the jagged image edge at the irregular edge Y.

Figure 14:
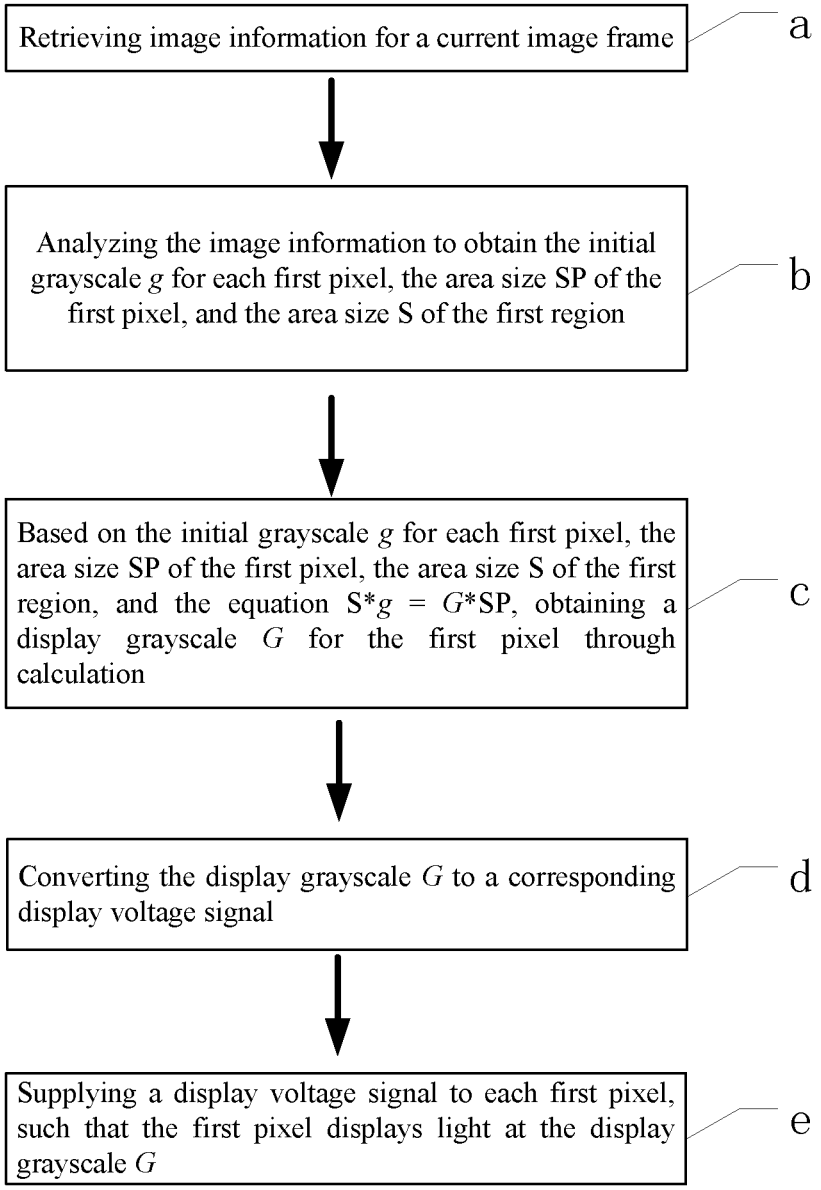
FIG. 14 illustrates a flow chart of an exemplary display panel driving method according to the disclosed embodiments.

FIG. 14 illustrates a flow chart of an exemplary display panel driving method according to the disclosed embodiments. Referring to FIG. 6 and FIG. 14, the driving method for the disclosed display panel may include the following steps.

Step a: retrieving image information for a current image frame. In particular, the initial grayscale g for each pixel in the current image frame may be retrieved.

Step b: analyzing the image information to obtain the initial grayscale g for each first pixel 10, the area size SP of the first pixel, and the area size S of the first region. In particular, after the display apparatus is fabricated, the area size SP of each first pixel 10 may be fixed. Moreover, the irregular edge Y may also be fixed. Thus, the area size S of the first region 11 in each first pixel 10 may be fixed as well. The area size SP of each first pixel 10 and the area size S of the first region 11 in each first pixel 10 may be pre-configured. In the Step b, only the initial grayscale g for each first pixel 10 in each image frame may be desired to be obtained.

Step c: based on the initial grayscale g for each first pixel, the area size SP of the first pixel, the area size S of the first region, and the equation S*g=G*SP, obtaining a display grayscale for the first pixel through calculation.

Step d: converting the display grayscale G to a corresponding display voltage signal. In particular, a calculation equation may be pre-configured. The calculation equation may use the display grayscale G to calculate a corresponding display voltage signal.

Step e: supplying the display voltage signal to the corresponding first pixel such that the first pixel displays light at the display grayscale G.

In the driving method for the disclosed display panel, the image information may be retrieved, the image information may be analyzed, the display grayscale G for the first pixel may be calculated and converted into the corresponding display voltage signal, and finally the display voltage signal may be supplied to the corresponding first pixel such that the first pixel may actually display light at the display grayscale G. Thus, the jagged image edge at the irregular edge Y may be suppressed.

The present disclosure provides a display panel, a display apparatus, and a driving method for the display panel.

In the disclosed display panel, the display region includes at least one irregular edge. The pixels intersecting the irregular edge are first pixels. Each first pixel has an initial grayscale g. In the display phase of the display panel, the grayscale for each first pixel may be adjusted such that the first pixel displays light at the display grayscale G, where G<g. In the display phase, the grayscale of each first pixel is reduced from the initial grayscale g to the display grayscale G. Thus, the jagged image edge at the irregular edge may be suppressed, and the display performance may be enhanced. The display apparatus has the features and functions provided by the disclosed display panel.

In the driving method for the disclosed display panel, the image information may be retrieved, the image information may be analyzed, the display grayscale G for the first pixel may be calculated and converted into the corresponding display voltage signal, and finally the display voltage signal may be supplied to the corresponding first pixel such that the first pixel may actually display light at the display grayscale G. Thus, the jagged image edge at the irregular edge Y may be suppressed, and the display performance may be enhanced.

Various embodiments have been described to illustrate the operation principles and exemplary implementations. It should be understood by those skilled in the art that the present invention is not limited to the specific embodiments described herein and that various other obvious changes, rearrangements, and substitutions will occur to those skilled in the art without departing from the scope of the invention. Thus, while the present invention has been described in detail with reference to the above described embodiments, the present invention is not limited to the above described embodiments, but may be embodied in other equivalent forms without departing from the scope of the present invention, which is determined by the appended claims.

What is claimed is:

1. A display panel, comprising:

a display region including a plurality of pixels arranged in both a first direction and a second direction, wherein the first direction intersects the second direction; and a non-display region surrounding the display region, wherein:

the display region includes at least one irregular edge intersecting both the first direction and the second direction;

the plurality of pixels includes a plurality of first pixels intersecting the at least one irregular edge and a plurality of second pixels without intersecting the at least one irregular edge;

a first pixel has an initial grayscale g;

in a display phase of the display panel, the initial grayscale g of the first pixel is adjusted to a display grayscale G, where G<g;

the at least one irregular edge has a first side adjacent to the display region and a second side far away from the display region;

the first pixel is divided by the at least one irregular edge into a first region disposed on the first side of the at least one irregular edge and a second region disposed on the second side of the at least one irregular edge; and S*g=G*SP, where SP is an area size of the first pixel, and S is an area size of the first region in the first pixel.

2. The display panel according to claim 1, wherein:

the first pixel is a square having a side of a, and $SP=a^2$, where SP is an area size of the first pixel.

3. The display panel according to claim 1, wherein:

the at least one irregular edge is an arc having a radius of R.

4. The display panel according to claim 1, wherein:

a pixel includes a first color sub-pixel, a second color sub-pixel, and a third color sub-pixel.

5. The display panel according to claim 1, wherein:

the display panel is a liquid crystal display panel or an organic light emitting diode display panel.

6. A display apparatus, comprising a display panel including:

a display region including a plurality of pixels arranged in both a first direction and a second direction, wherein the first direction intersects the second direction; and a non-display region surrounding the display region, wherein:

the display region includes at least one irregular edge intersecting both the first direction and the second direction;

the plurality of pixels includes a plurality of first pixels intersecting the at least one irregular edge and a plurality of second pixels without intersecting the at least one irregular edge;

a first pixel has an initial grayscale g;

in a display phase of the display panel, the initial grayscale g of the first pixel is adjusted to a display grayscale G, where G<g;

the at least one irregular edge has a first side adjacent to the display region and a second side far away from the display region;

the first pixel is divided by the at least one irregular edge into a first region disposed on the first side of the at least one irregular edge and a second region disposed on the second side of the at least one irregular edge; and S*g=G*SP, where SP is an area size of the first pixel, and S is an area size of the first region in the first pixel.

7. The display apparatus according to claim 6, further including:

a chip supplying a display voltage signal to the first pixel, such that the first pixel exhibits the display grayscale G.

8. The display apparatus according to claim 7, wherein:

the chip includes a voltage conversion circuit, which converts the display grayscale G to a corresponding display voltage signal.

9. The display apparatus according to claim 8, wherein:

the chip further includes a grayscale calculation circuit; and based on the initial grayscale g of the first pixel, the area size SP of the first pixel, the area size S of the first region in the first pixel, and the equation S*g=G*SP, the grayscale calculation circuit calculates the display grayscale G for the first pixel.

10. The display apparatus according to claim 9, wherein:

the chip further includes an image information retrieval circuit; and the image information retrieval circuit retrieves image information for a current image frame.

11. The display apparatus according to claim 10, wherein:

the chip further includes an image information processing circuit; and the image information processing circuit analyzes the retrieved image information to obtain the initial grayscale g for the first pixel, the area size SP of the first pixel, and the area size S of the first region in the first pixel.

12. The display apparatus according to claim 11, further comprising:

a first chip including the voltage conversion circuit and the grayscale calculation circuit; and a second chip including the image information retrieval circuit and the image information processing circuit.

13. A driving method for a display panel, the display panel comprising:

a display region including a plurality of pixels arranged in both a first direction and a second direction, wherein the first direction intersects the second direction; and a non-display region surrounding the display region, wherein:

the display region includes at least one irregular edge intersecting both the first direction and the second direction;

the plurality of pixels includes a plurality of first pixels intersecting the at least one irregular edge and a plurality of second pixels without intersecting the at least one irregular edge;

a first pixel has an initial grayscale g;

in a display phase of the display panel, the initial grayscale g of the first pixel is adjusted to a display grayscale G, where G<g;

the at least one irregular edge has a first side adjacent to the display region and a second side far away from the display region;

the first pixel is divided by the at least one irregular edge into a first region disposed on the first side of the at least one irregular edge and a second region disposed on the second side of the at least one irregular edge; and S*g=G*SP, where SP is an area size of the first pixel, and S is an area size of the first region in the first pixel, and the driving method comprising:

in the display phase of the display panel, supplying a display voltage signal to the first pixel, such that the first pixel exhibits the display grayscale G, where G<g, and based on the initial grayscale g for each first pixel, the area size SP of the first pixel, the area size S of the first region, and the equation S*g=G*SP, calculating the display grayscale G of the first pixel.

14. The driving method according to claim 13, further including:

retrieving image information for a current image frame;

analyzing the image information to obtain the initial grayscale g for the first pixel, the area size SP of the first pixel, and the area size S of the first region in the first pixel; and converting the display grayscale G to a corresponding display voltage signal.

* * * * *